United States Patent [19]

Tomita et al.

[11] Patent Number: 4,499,849

[45] Date of Patent: Feb. 19, 1985

[54] APPARATUS FOR CLEANING A RECORDING MEDIUM

[75] Inventors: Satoru Tomita; Akira Shimura, both of Kawasaki; Takashi Yokota, Tokyo, all of Japan

[73] Assignee: Ricoh Company, Ltd., Japan

[21] Appl. No.: 365,469

[22] Filed: Apr. 5, 1982

[30] Foreign Application Priority Data

Apr. 6, 1981 [JP] Japan ..... 56-51578
Apr. 10, 1981 [JP] Japan ..... 56-53909

[51] Int. Cl.[3] ..... G03G 21/00
[52] U.S. Cl. ..... 118/652; 355/15
[58] Field of Search ..... 118/652, 645, 203, 104; 430/125; 355/4, 15; 15/256.52

[56] References Cited

U.S. PATENT DOCUMENTS 3,510,903 5/1970 Stoever et al. ..... 118/652 X
3,919,973 11/1975 Zimmer ..... 118/213 X
3,923,004 12/1975 Eichorn et al. ..... 118/652
4,097,140 6/1978 Suzuki et al. ..... 118/652 X
4,188,907 2/1980 Lipani ..... 118/657
4,230,406 10/1980 Klett ..... 15/256.52 X
4,259,003 3/1981 Mangal et al. ..... 118/652 X
4,263,390 4/1981 Yamashita et al. ..... 118/652 X
4,272,184 6/1981 Rezanka ..... 118/652 X
4,311,110 1/1982 Matsumura et al. ..... 118/652 X

*Primary Examiner*—John P. McIntosh
*Attorney, Agent, or Firm*—Guy W. Shoup

[57] ABSTRACT

An apparatus for cleaning a recording medium is provided. The cleaning apparatus of the present invention is applicable to an electrophotographic or electrographic recording system. The present cleaning apparatus comprises a toner cleaner for removing residual toner particles from the surface of a recording medium, a counter member disposed on the opposite side of the recording medium with respect to the toner cleaner, and a mechanism for urging at least either one of the toner cleaner and the counter member against the other. Accordingly, the recording medium is kept in pressure contact with the toner cleaner so that cleaning of the recording medium may be carried out at upmost efficiency at all times. Besides, due to the provision of the urging mechanism, the alignment of parts is made less severe in assemblage of the apparatus, thus facilitating the manufacturing process.

21 Claims, 24 Drawing Figures

APPARATUS FOR CLEANING A RECORDING MEDIUM

BACKGROUND OF THE INVENTION 1. Field of the Invention

This invention relates to an apparatus for cleaning a recording medium and more in particular to a cleaning apparatus for removing color particles, such as toner, which remain on the surface of a recording medium after image transfer thereby preparing the medium for the next cycle of operation.

Described more specifically, in electrophotography or electrographic recording, on a recording medium is formed an electrostatic latent image, which is then developed by color particles such as toner, magnetic or non-magnetic, to form a developed, visible image, which, in turn, is transferred to a transfer material, thereby obtaining a copy of an original image. However, since some toner particles remain on the surface of the recording medium after image transfer, the surface of the recording medium must be cleaned or the residual toner particles must be removed in order to prepare for the next cycle of operation. The present invention is concerned with a cleaning apparatus to be used in such circumstance. 2. Description of the Prior Art An apparatus for cleaning the surface of a recording medium after image transfer is well known in the art. One such prior art cleaning apparatus is comprised of a non-magnetic sleeve, on the outer surface of which is planted short fibers, and magnets disposed inside of the sleeve. For example, use is made of aluminum to form a non-magnetic sleeve, and a fiber material having the thickness ranging approximately from 0.3 mm to 1 mm, the fiber material being made of synthetic fibers, such as nylon and rayon, of natural fibers, such as cotton and wool, or of conductive fibers, such as carbon or metal, is adhered to the outer surface of the sleeve, which is then rotatably disposed with a gap ranging approximately from 0.2 mm to 0.5 mm between the outer surface of the sleeve and the surface of the recording medium, whereby the fiber material is pressed over a distance ranging approximately from 0.1 mm to 0.5 mm. Since the sleeve is rotated under the condition, residual toner on the surface of the recording medium is removed and, therefore, the medium is cleaned and made ready for use in the next cycle of operation. In the case of one-component or magnetic toner particles, they are attracted to the outer surface of the sleeve due to magnetic forces exerted by the magnets disposed inside of the sleeve. Thus, cleaning of magnetic toner particles is carried out in two-fold—mechanical scraping or separation of particles from the recording medium by fibers and magnetic attraction of particles toward the outer surface of the sleeve. As the sleeve rotates, the toner particles collected on the outer surface of the sleeve are carried to a desired location.

In a cleaning apparatus of the type described above, it is important to maintain the gap between the sleeve and the recording medium at constant in order to attain an excellent cleaning performance. Stated in another way, the contact between the fabric material adhered to the sleeve and the surface of the recording medium must be held uniformly or invariably throughout cleaning operation. Otherwise, irregularities in cleaning result so that some residual toner particles remain unremoved, which will provide adverse effects to the next cycle of operation. For this reason, one prior art approach to cope with this problem is to provide a pair of bearings having the outer diameter slightly larger than that of the sleeve on both ends of the sleeve. With such a structure, the sleeve is rotated with the bearings in contact with the surface of the recording medium so that the gap between the sleeve and the recording medium may be maintained at constant. However, such a structure is rather complicated and thus tends to be expensive. More importantly, when toner or other foreign matter is stuck to the bearings or to that portion of the recording medium which comes into contact with the bearings, the gap between the sleeve and the recording medium will fluctuate thereby bringing about irregularities in cleaning performance.

SUMMARY OF THE INVENTION

The disadvantages of the prior art are overcome with the present invention and an improved apparatus for cleaning a recording medium or removing particles such as toner from the surface of a recording medium is provided.

The advantages of the present invention are mainly attained by providing a cleaning apparatus for a recording medium having a recording surface on one side and a back surface on the opposite side which comprises means for removing color particles from the recording surface of said recording medium, said means for removing being disposed on the recording surface side of said recording medium; a counter member disposed on the back surface side of said recording medium; means for urging at least either one of said means for removing and said counter member against the other thereby bringing said means for removing and said counter member in an intended pressure contact with said recording medium from both sides; and means for causing a relative motion between said means for removing and said recording medium thereby allowing said means for removing to remove the color particles from the recording surface of said recording medium.

Preferably, the means for removing includes a sleeve which is driven to rotate and the outer surface of which is brought into contact with the recording surface of the recording member to collect the color particles thereon as removed from the recording surface. The sleeve may be made of a non-magnetic material in which case it is preferable to provide a plurality of magnets inside of the sleeve. Alternatively, the sleeve itself may be made of magnets. Preferably, the outer surface of the sleeve is provided with a fiber material having a predetermined thickness thereby enhancing mechanical capability in collecting color particles.

Preferably, the counter member is formed by a part of a support member which operatively supports the recording medium. For example, the recording medium may be formed in the form of an endless belt, in which case such an endless belt-type recording medium may be extended between a pair of rollers rotatably supported by the support member. Such a support member may be structured to be freely shiftable in position with respect to the rotatable sleeve and urging means, preferably a spring, may be provided to urge the support member, preferably its top plate, against the sleeve with a part of the endless belt-type recording medium between them.

Alternatively, the counter member may be formed by a separate element, preferably in the form of a piece of bar having substantially the same length as the sleeve.

Such a bar-like counter member may be held in position, for example, by providing a recess or hole in the top plate of the support member and keeping the bar-like counter member in the recess or hole. This is advantageous because the counter member may be formed in any desired shape in cross section in order to attain further improvements in cleaning performance. Moreover, such a bar-like counter member may be made of a magnet or magnetic material in order to create an attractive magnetic force acting between the means for removing and the counter member.

With the above-described structure, a part of the recording medium is always insured to be held in pressure contact with the cleaning sleeve and the counter member during the entire cleaning operation. Uniform contact between the cleaning sleeve and the recording medium allows to obtain excellent cleaning performance.

Therefore, it is an object of the present invention to provide an apparatus for cleaning a recording medium in which a contact condition between a cleaning element and the surface of a recording medium to be cleaned may be maintained at constant during the entire cleaning operation.

Another object of the present invention is to provide a cleaning apparatus of a recording medium which is simple in structure and thus easy to manufacture.

A further object of the present invention is to provide a cleaning apparatus for cleaning the surface of a recording medium after the transfer of a toner image formed thereon to a transfer medium.

A still further object of the present invention is to provide a cleaning apparatus which allows the use of a recording medium repetitively over a great number of times.

Other objects, advantages and novel features of the present invention will become apparent from the following detailed description of the invention when considered in conjunction with the accompanying drawings.

DESCRIPTION OF THE PREFERRED EMBODIMENTS

Figure 1:
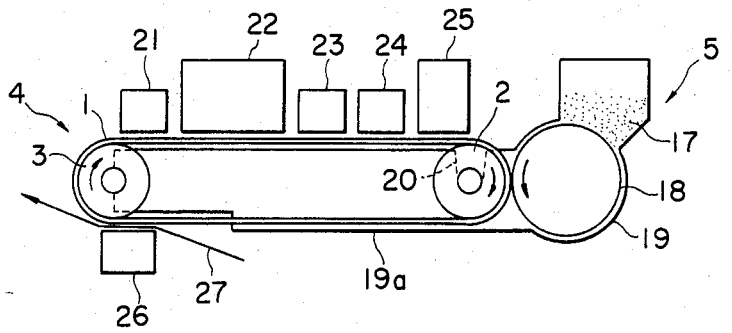
FIG. 1 is a schematic illustration showing one example of a recording system to which the present cleaning apparatus may be applied.

Referring to FIG. 1, there is shown one example of a recording system to which the present invention may be applied. The recording system includes a photosensitive member 1 in the form of an endless belt, which is extended between a pair of support rollers 2 and 3 so that it can advance in the clockwise direction. The roller 2 is a driving roller and the roller 3 is a follower roller. In this recording system, a structure for supporting the photosensitive member 1 in an operative fashion and a developing section are constructed in the form of a unit in order to facilitate exchange of photosensitive members and maintenance of the entire machine. That is, a photosensitive member support unit 4 is detachably mounted on a developing unit 5, which, in turn, is detachably mounted on the main body of the recording system.

Figure 2:
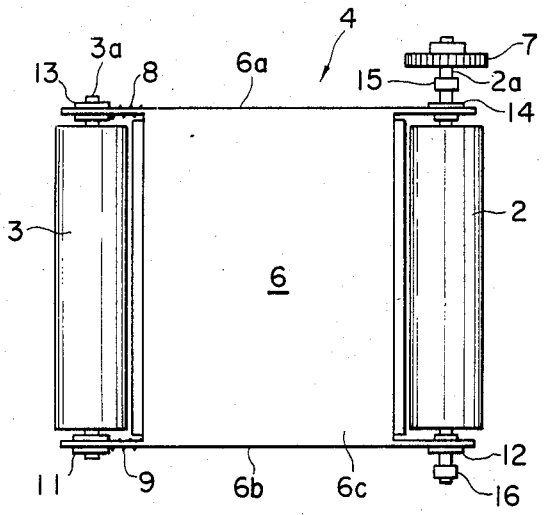
FIG. 2 is a top plan view showing a part of the recording system of FIG. 1 with the photosensitive belt removed.
Figure 3:
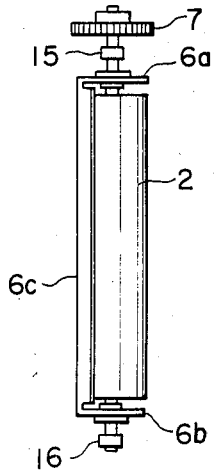
FIG. 3 is a side-elevational view of the structure shown in FIG. 2.
Figure 4:
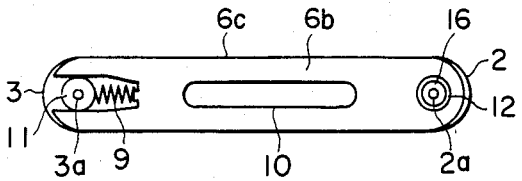
FIG. 4 is a front view of the structure shown in FIG. 2.

As best shown in FIGS. 2 through 4, the photosensitive member support unit 4 comprises a support member 6 which includes side plates **6*a*, 6*b* and a top plate 6*c* which supports from underside the top belt portion of the photosensitive belt 1 thereby providing a guide along which the belt travels. The rollers 2 and 3 are rotatably supported by the side plates 6*a* and 6*b*. That is, the roller 2 is journalled to the side plates 6*a*, 6*b* and it has a shaft 2*a* to which is fixedly provided an externally driven gear 7. On the other hand, a notch is provided at the opposite end of each of the side plates 6*a*, 6*b* and the shaft 3*a* of the follower roller 3 is loosely fitted into the notches with springs 8, 9 inserted between the shaft 3*a* and the bottom of the notches. Thus, the endless belt 1 is held in tension due to the recovery force of the springs 8, 9. A slot 10 is provided in each side plate 6*a*, 6*b* thereby making the unit light-weighted and facilitating handling of the unit. The shafts 2*a*, 3*a* of the rollers 2 and 3 are rotatably supported by the support member 6 through a pair of bearings 12 and 14, 11 and 13, respectively. Furthermore, the shaft 2*a* of the driving roller 2 is provided with additional bearings 15 and 16 which are to be used in engagement with the developing unit 5**.

Referring back to FIG. 1, the developing unit 5 includes a container 19 which stores therein a quantity of toner 17 and a developing roller 18 and a receiving section **19*a* comprised of a bottom plate and a pair of side plates for partly housing the photosensitive member support unit 4. The side plates of the receiving section 19***a* are each provided with a groove 20 into which the bearings 15, 16 of the driving roller 2 are fitted to complete engagement between the support unit 4 and the developing unit 5 whereby a predetermined relative positional relation between the photosensitive belt 1 and the developing roller 18 is obtained.

As shown in FIG. 1, above the top portion of the photosensitive belt 1 are disposed a first discharging device 21, a cleaning apparatus 22, a second discharging device 23, a charging device 24 and an image exposure device 25; whereas, an image transferring device 26 is disposed at the left end of the bottom belt portion. It should be understood that all of these devices and apparatus are fixedly mounted on the frame or main body of the recording system at their respective predetermined positions. Thus, when the developing unit 5 to which the photosensitive member support unit 4 is mounted is placed into a predetermined position of the main body by means of any positioning means well known in the art, the photosensitive belt 1 becomes positioned in a predetermined manner with respect to any other devices mounted on the main frame.

As indicated by the arrows in FIG. 1, the photosensitive belt 1 travels in the clockwise direction. As it advances, the belt 1 is uniformly charged to a desired polarity by the charger 24 and then a light image is exposed to the thus charged belt 1 to form an electrostatic latent image. Then, at the developing section 5, the toner 17 is supplied to the latent image as carried by riding on the peripheral surface of the developing roller 18 so that the latent image is developed thereby forming a visible powder image. The thus formed visible image is then transferred to a transfer medium 27 at the image transferring device 26 since the transfer medium 27 is brought into contact with the recording surface, on which a toner image is formed, of the photosensitive belt. The transfer medium now bearing thereon the transferred toner image is then separated from the photosensitive belt 1 and then transported to a desired location with or without additional steps such as fusing and drying. On the other hand, the photosensitive belt 1 from which the transfer medium 27 has been separated is subjected to the first and second discharging devices 21 and 23 thereby eliminating the residual charges and to the cleaning apparatus 22 thereby removing the residual toner particles remaining on the photosensitive belt 1. It is to be noted that the toner particles 17 may include a magnetic material—so-called one component toner particles.

Figure 5:
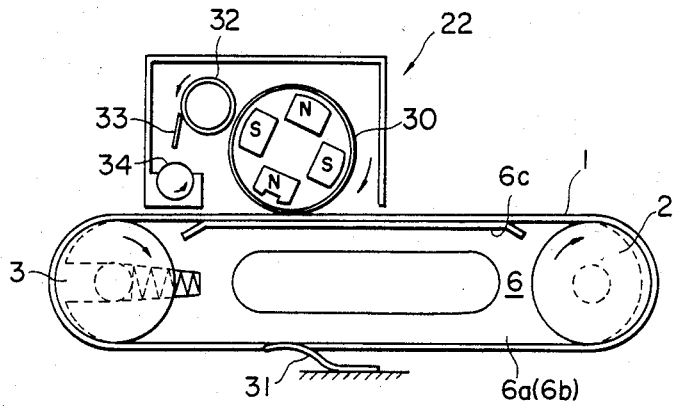
FIG. 5 is a schematic illustration showing one embodiment of the present cleaning apparatus.

Now, a detailed description will be had with respect to the cleaning apparatus 22 which is the subject matter of the present invention. As shown in FIG. 5, the cleaning apparatus 22 embodying the present invention includes a non-magnetic sleeve 30 which is supported to be driven to rotate in the clockwise direction and a plurality of magnets which are disposed inside of the sleeve 30 stationarily with respect thereto. It is to be understood that such a structure is employed when use is made of magnetic toner particles as a developer. Preferably, a brush or fiber material may be provided as adhered to the outer surface of the sleeve 30. Alternatively, the sleeve 30 itself may be made of magnets or a magnetic roller may be provided instead of the sleeve 30. Other alternative structures for the cleaning apparatus 22 include the use of a fur brush, magnetic brush, blade, etc. It should be noted that in accordance with the present invention, there is provided a counter member on that side of the recording medium opposite from the recording surface side where a toner image is formed and the cleaning sleeve is brought into contact. In the embodiment shown in FIG. 5, the sleeve 30 is in rubbing contact with the recording surface of the photosensitive belt 1 and the top plate 6*c* of the support member 6 is disposed to be in contact with the back surface of the belt 1. In this case, the top plate 6*c* constitutes the counter member of the present invention.

It should further be noted that in accordance with the present invention, at least either one of the cleaning sleeve and the counter member is provided to be freely shiftable in position with respect to the other and there is provided means for urging at least one of them against the other with a part of the recording medium sandwiched therebetween. In the embodiment of FIG. 5, a predetermined clearance is provided between the shafts of the rollers 2, 3 and the side plates 6*a*, 6*b* of the support member 6. In other words, the rollers 2, 3 are in loose connection with the support member 6 so that the top plate 6*c* of the support member 6 is freely shiftable in position over a limited range with respect to the rollers 2, 3. Moreover, a leaf spring 31 is provided to be in contact with the bottom end of each of the side plates 6*a*, 6*b* so that the support member 6 is spring-biased upward thereby the top plate 6*c* presses the belt 1 against the sleeve 30.

It is to be noted that since the top plate 6*c*, which functions as a counter member of the present invention, is freely shiftable in position over a limited range and the top plate 6*c* is urged upward by means of the leaf springs 31, even if the belt 1 is not accurately aligned in parallel with the top plate 6*c*, the recording surface of the belt 1 may be brought into uniform contact with the sleeve 30 so that removal of the residual toner particles remaining on the belt 1 can be carried out effeciently as well as uniformly at all times. The toner particles thus removed from the belt 1 are collected on the outer peripheral surface of the sleeve 30 so that they are transported along the circumference of the sleeve 30 as the sleeve 30 rotates. Then the toner particles riding on the sleeve 30 are transferred to a magnetic roller 32 because the toner particles in this embodiment are assumed to contain a magnetic material. The toner particles thus transferred to the magnetic roller 32 are scraped off by a blade 33 which is in scrubbing contact with the magnetic roller 30. Finally, the thus scraped toner particles are transported to a desired location by means of an auger screw 34.

Figure 6:
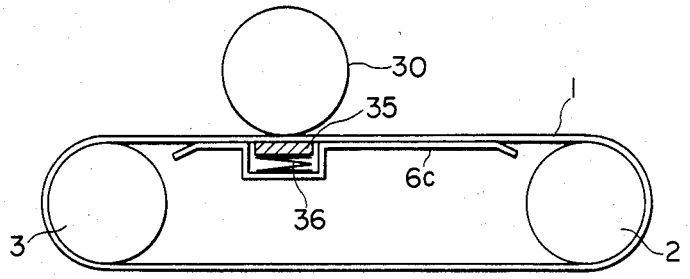
FIGS. 6 through 9 are schematic illustrations showing different embodiments of the present cleaning apparatus.
Figure 7:
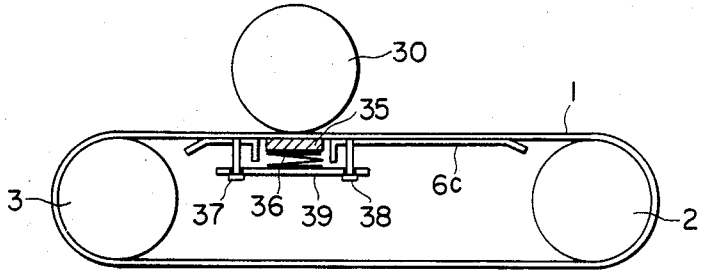

In the embodiment described above, the top plate 6*c* is employed as a counter member of the present invention. However, as shown in FIG. 6, use may be made of a separate counter member 35 in the form of a bar which is loosely fitted in a recess provided in the top plate 6*c* at the location opposite to the sleeve 30. A coil spring 36 is provided in the recess so that the bar-like counter member 35 pushes the belt against the sleeve 30. The bar-like counter member 35 has approximately the same length as the sleeve 30. It is important to note that the counter member 35 is loosely fitted in the recess and simply supported by the coil spring 36. With such a structure, the recording surface of the belt 1 is brought into uniform contact with the sleeve 30. For this reason, uniformity in contact pressure acting between the sleeve 30 and the belt 1 is insured, which allows to obtain an excellent performance in the cleaning of a recording medium. An appropriate number of springs 36 may be provided—for example, only one spring in the middle of the recess with respect to the width-wise direction of the top plate *6c* or a pair of springs on both ends of the recess. FIG. 7 shows a further modification of the above-described embodiment in which the top plate *6c* is provided with an opening into which the counter member 35 is loosely fitted. The counter member 35 is placed on the coil spring 36 which rides on a receiving plate 39 which, in turn, is loosely supported by pins 37, 38 planted in the top plate *6c*.

Figure 8:
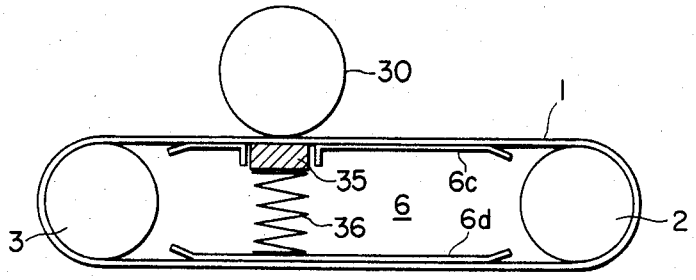
Figure 9:
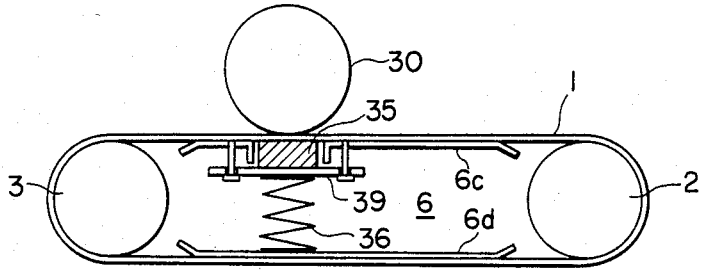

FIG. 8 shows a still further embodiment of the present invention in which the member 6 includes a bottom plate *6d* in addition to the top plate *6c*. In this case, an opening is provided in the top plate *6c* and the counter member 35 is loosely fitted in the opening with the coil spring 36 extending between the counter member 35 and the bottom plate *6d*. Such a structure functions virtually in a similar manner as any of the previously described embodiments. This embodiment may be further modified to the structure of FIG. 9 in which the coil spring 36 is extended between the receiving plate 39 and the bottom plate *6d*.

Figure 10:
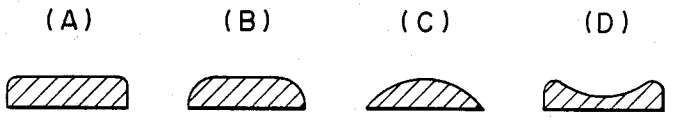
FIGS. 10 (A) through (D) are cross-sectional views of the counter member to be used in some embodiments of the present cleaning apparatus.

As shown in FIGS. 10 (A) through (D), the top surface of the counter member 35 may be contoured to any desired shape in order to attain a particularly intended effect such as a maximum possible reduction in frictional resistance between the belt 1 and the counter member 35 to lower the load in drivement of the belt 1 or a maximum possible increase in contact area between the sleeve 30 and the belt 1 to attain enhancement in cleaning effect. FIG. 10 (A) shows the case where the leading and trailing edges of the top surface of the counter member 35 are rounded and FIG. 10 (B) shows the case where these edges are more rounded. FIG. 10 (C) shows the case where the top surface is formed as a convex-like surface; whereas, FIG. 10 (D) shows the case where the top surface presents a concave-like surface with its leading and trailing edges rounded.

Figure 11:
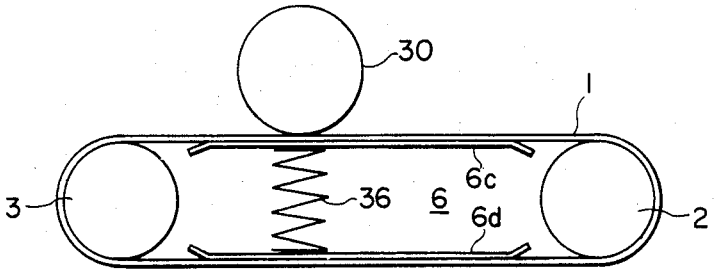
FIG. 11 is a schematic illustration showing a further embodiment of the present cleaning apparatus.

FIG. 11 shows a still further modification in which the top plate *6c* is provided to be separate from the support member 6 and loosely supported by the shafts of the rollers 2, 3. The coil spring 36 is provided to extend between the independent top plate *6c* and the bottom plate *6d* so that the top plate *6c* pushes the belt 1 against the sleeve 30 by means of the spring 36. Such a separate top plate *6c* may be reduced to a size comparable to the sleeve 30.

It is to be noted that in the embodiments shown in FIGS. 6 through 9 and 11, since the spring 36 functions to keep the belt 1 in tension, the springs 8, 9 may be omitted.

It should be appreciated that the means for urging at least either one of the cleaning sleeve and the counter member against the other in the present invention is not limited to springs, though all of the above-described embodiments employ springs as urging means. That is, in the case where the cleaning apparatus comprises a non-magnetic sleeve and magnets disposed inside of the sleeve or in the case where the cleaning apparatus comprises a rotary member or blade which is formed by magnets or to which magnets are attached, magnetic forces exerted by these magnets may be utilized to attract the counter member toward the sleeve thereby attaining a desired contact condition between the sleeve and the belt.

Figure 12:
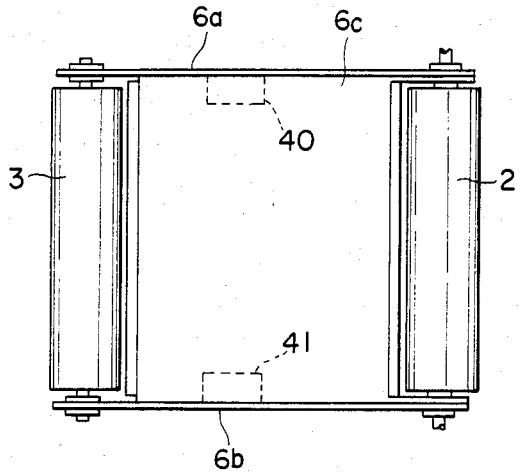
FIG. 12 is a top plan view showing a part of the recording system to which the present invention is applied wherein use is made of a pair of magnetic counter members.
Figure 13:
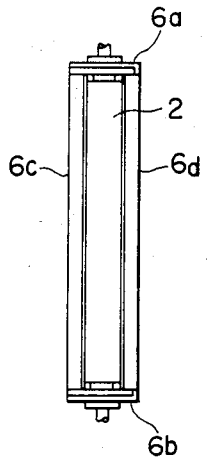
FIG. 13 is a side-elevational view of the structure shown in FIG. 12.

Referring now to FIGS. 12 and 13, another embodiment of the present invention in which use is made of magnetic forces as the urging means will be described. In this embodiment, the top plate *6c* is provided to be separate from the support member 6 in such a manner that the top plate *6c* is pivotally movable around the shaft of the roller 2, and the support member 6 includes the bottom plate as well as the side plates *6a*, *6b*. As best shown in FIG. 12, a pair of magnets 40 and 41 are fixedly attached to the rear surface of top plate *6c* one on each side and outside of the effective cleaning region. These magnets 40, 41 must be so arranged that the forces acting between the magnets 40, 41 and the sleeve 30 or the magnets disposed inside of the sleeve 30 are attractive and not repulsive. As a result, that part of the photosensitive belt 1 riding on the top plate *6c* is brought into pressure contact with the sleeve 30.

Figure 14:
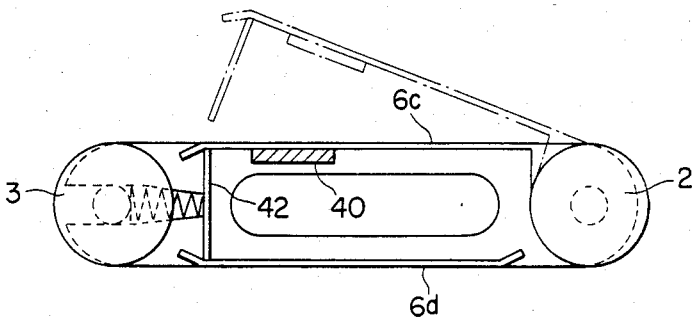
FIGS. 14 through 18 are schematic illustrations showing several embodiments of the present cleaning apparatus in which use is made of a magnetic counter member.

In the above embodiment, since the top plate *6c* is provided to be freely pivotal around the shaft of the roller 2, there must be provided a stopper which limits a further downward movement of the top plate *6c* beyond a predetermined point. The simplest example of such a stopper may be formed by top edges of the side plates *6a*, *6b*. In such a structure, the top plate *6c* comes into abutment against the top end edges of the side plates *6a*, *6b* when it moves in the counter-clockwise direction by its own weight. Alternatively, a stopper 42 extending in the direction approximately perpendicular to the top plate *6c* may be fixedly attached to the forward end of the top plate *6c*, as shown in FIG. 14. In this case, the rotation of the top plate *6c* is restrained when the bottom end of the stopper 42 comes into abutment against the bottom plate *6d*.

Figure 15:
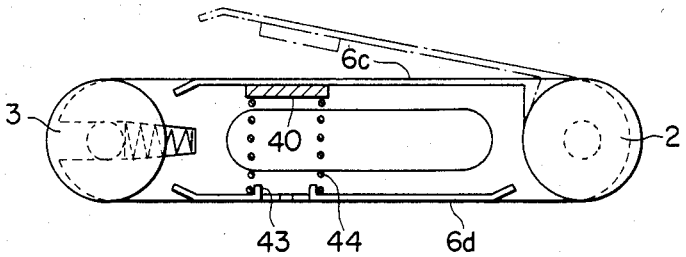

On the other hand, as shown in FIG. 15, a projection 43 may be formed by punching to project inwardly from the bottom plate *6d* and a coil spring 44 may be provided with its bottom end in engagement with the projection 43 for holding the spring 44 in position. Thus, in this example, the coil spring 44 is used as a stopper on which the top plate *6c* can rest. Such a coil spring 44, which functions as a stopper, may be provided with an appropriate number—for example, only one in the middle or one on each side.

Figure 16:
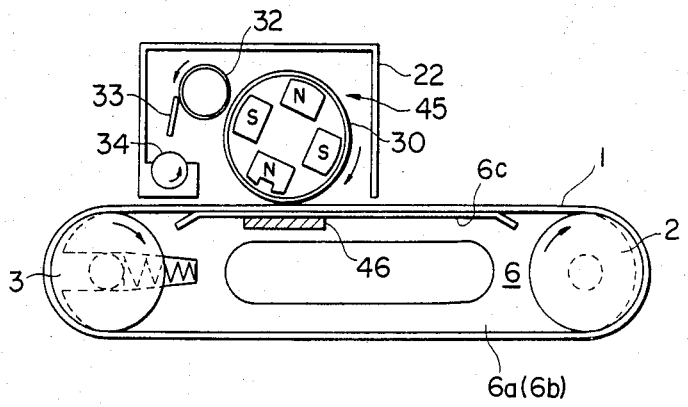

FIG. 16 shows a further embodiment of the present invention in which magnetic attractive forces are positively employed to attain a desired pressure contact between a toner cleaner and a recording medium. It should be noted that as practiced throughout this specification, like reference numerals indicate like elements.

Figure 19:
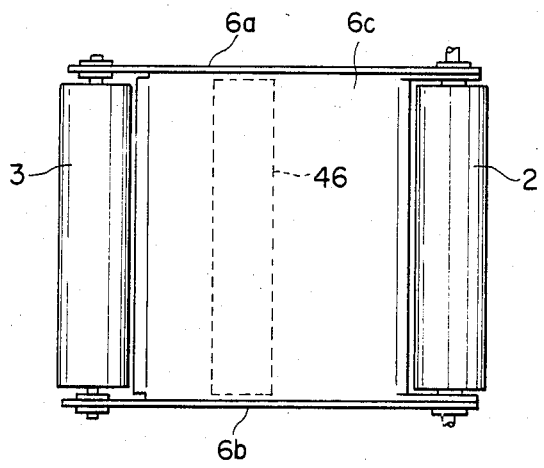
FIG. 19 is a top plan view showing a part of the recording member to which the present invention is applied with the use of a bar-like magnetic counter member.

As shown in FIG. 16, there is provided a toner cleaner 45 comprised of a rotating, non-magnetic sleeve 30 and a plurality of stationary magnets disposed inside of the sleeve 30. The toner cleaner 45 is so structured that it applies a magnetic field through that part of the photosensitive belt 1 where magnetic toner particles remaining on the belt 1 are to be removed. Thus, the toner cleaner 45 may take any arbitrary form other than that shown in FIG. 16. As is also shown, there is provided a magnetic counter member 46 comprised of a magnetic material or magnet as fixedly attached to the bottom surface of the top plate *6c* at a location opposite to the sleeve with a part of the belt 1 sandwiched therebetween. The counter member 46 is generally in the form of a bar having the length substantially the same as that of the sleeve 30. The arrangement of this bar-like counter member 46 is best shown in FIG. 19. If use is made of a magnet for the counter member 46, its orientation in mounting must be carefully determined such that a magnetic field in attraction is formed between the magnets inside of the sleeve 30 and the magnetic counter member 46. If desired, the polarity of either of the magnets inside of the sleeve 30 or the magnetic counter member 46 may be reversed to create a repulsive magnetic field therebetween when the apparatus is not in use.

Figure 17:
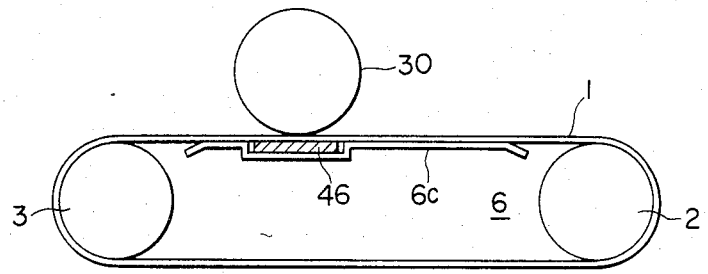
Figure 18:
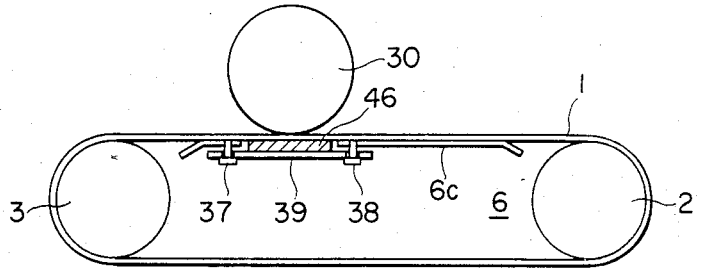

As is obvious, in the embodiment of FIG. 16, the entire support member 6 is moved upward due to magnetic attractive force to bring the belt 1 in pressure contact with the sleeve 30. As shown in FIG. 17, however, the counter member 46 may be provided as a separate element loosely fitted in a recess formed in the top plate 6*c*. FIG. 18 shows a further modification in which the counter member 46 is loosely fitted in an opening provided in the top plate 6*c*. The counter member 46 may simply rest on the receiving plate 39 supported by the pins 37, 38, or it may be fixed to the receiving plate 39, in which case the receiving plate 39 must be loosely supported by the pins 37, 38. The magnetic counter member 46 may have a profiled top surface as shown in FIGS. 10 (A) through (D).

In the case where the counter member 46 is made of a magnetic material or magnet as described above, it is directed not only to make the contact between a toner cleaner and a recording medium uniform but also to improve the cleaning effect by causing to move the residual toner particles on the recording medium with the help of a magnetic field created therethrough. It should however be noted that difficulties are sometimes encountered in creating an effective magnetic field to cause residual toner particles move away from the recording medium from various reasons such as manufacturing tolerances and aging.

In order to cope with this, the present invention proposes to provide the toner cleaner 45 and the counter member 46 in such a manner that the relative positional relation may be adjusted. Either one of the two may be adjustably provided with respect to the other, which is stationary, without loss of intended effects; however, it is more preferable to structure the counter member 46 adjustable in position in relation to a power transmission system.

Figure 20:
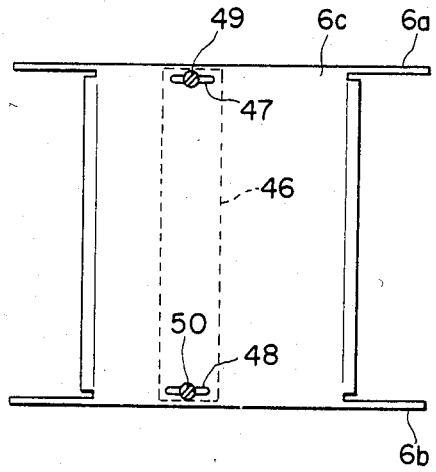
FIGS. 20 through 22 are schematic illustrations showing several embodiments in providing an adjustable counter member in accordance with the present invention.
Figure 21:
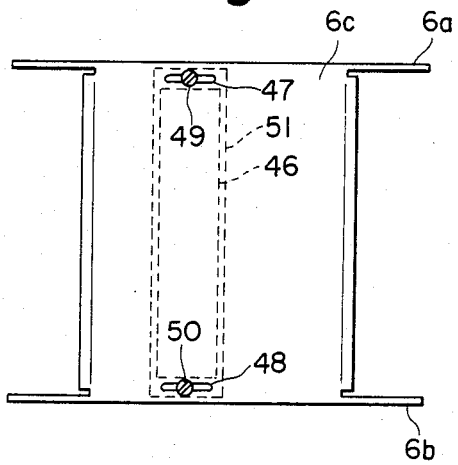
Figure 22:
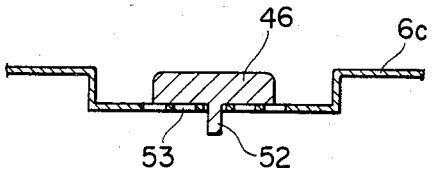

Use may be made of any well known structure in forming a mechanism for positional adjustment of the counter member 46. For example, as shown in FIG. 20, a pair of slots 47 and 48 may be provided on both sides of the top plate 6*c*—alternatively, in the side plates 6*a*, 6*b*—and screws 49, 50 may be screwed into the counter member 46 through the slots 47, 48, respectively. On the other hand, as shown in FIG. 21, the counter member 46 may be housed in a holder 51 which is adjustably mounted to the top plate 6*c* by means of screws 49, 50 which are screwed into the holder 51 through the slots 47, 48, respectively. FIG. 22 shows a further alternative in which a projection 52 is provided to project from the bottom surface of the counter member 46 and a plurality of holes 53 at different locations are provided in the top plate 6*c* so that the projection 52 may be snugly fitted into a selected hole 53.

Figure 23:
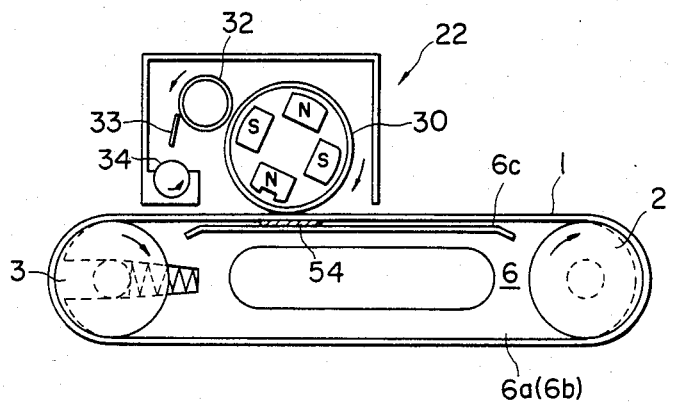
FIG. 23 is a schematic illustration showing a still further embodiment of the present cleaning apparatus in which use is made of a soft material at least that part of the counter member which is in contact with the recording member.

FIG. 23 shows a still further embodiment of the present invention in which there is provided a soft counter member 54 comprised of a soft material such as rubber, sponge, felt, fur or an enclosure of a shapeless material such as jelly and liquid. The word "soft" used herein is intended to include the meanings of flexibility, elasticity, or both. It is by no means necessary that the counter member 54 as a whole is made of a soft material. It should be noted that at least that part of the counter member 54, normally the top surface layer, which comes into contact with the belt 1 may be made of a soft material. Thus, the counter member 54, in fact, may be structured to have two layers. In this case, the top layer is made of a soft material since it comes into contact with the belt 1, but the bottom layer which is fixed to the top plate 6*c* may be made of a rigid material. Even in this case, the top soft layer must be thick enough to provide a required springy buffering action when it is pressed against the belt 1.

Figure 24:
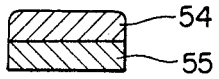
FIG. 24 is a cross-sectional view of the counter member with a magnetic member attached thereto in accordance with the present invention.

FIG. 24 shows the structure in which a magnetic material or magnet 55 is affixed to the bottom surface of the soft counter member 54. In this case, if a magnet is used, its orientation or the arrangement of poles must be carefully considered. If properly arranged, the counter member 54 may be brought into pressure contact with the belt 1 due to an attractive magnetic field produced between the magnets inside of the sleeve 30 and the magnet 55 affixed to the bottom surface of the counter member 54 without provision of any mechanical urging mechanism. This approach will help simplify the structure of the whole apparatus.

As described in detail above, in accordance with the present invention, a toner cleaner and a counter member are provided such that at least either one of them is urged against the other to bring the toner cleaner in pressure contact with a recording medium. It is to be noted that various mechanisms may be employed to cause a toner cleaner and/or a counter member urged against the other with a recording medium sandwiched therebetween. For example, if a spring is used for that purpose, its recovery force either in compression or tension may be employed. Moreover, the counter member may be held stationary and the toner cleaner may be provided to be shiftable in position with respect to the stationary counter member, or, alternatively, both of the counter member and the toner cleaner may be provided to be shiftable in position at the same time. The latter case is particularly useful if the recording medium lacks flexibility and is rather rigid or hard. It should further be noted that the recording medium may be formed of a dielectric material such as in electrographic recording. The form of the recording medium to be used in the present invention is not limited to an endless belt. Other forms such as a plate and a drum may be equally applicable.

While the above provides a full and complete disclosure of the preferred embodiments of the present invention, various modifications, alternate constructions and equivalents may be employed without departing from the true spirit and scope of the invention. Therefore, the above descrition and illustration should not be construed as limiting the scope of the invention, which is defined by the appended claims.

What is claimed is:

1. An apparatus for cleaning a recording medium in the form of an endless belt extended between at least a pair of rollers, having a recording surface on which a developed image is formed and a back surface which is on the opposite side of said recording surface, after transferring a developed image comprised of color particles and formed on said recording surface to a transfer medium thereby preparing said recording medium for use in the next cycle of operation, comprising:

means for removing residual color particles remaining on the recording surface of said recording medium after image transfer, said means for removing being disposed on the recording surface side of said recording medium;

supporting means for rotatably supporting said pair of rollers such that one of said rollers is spring-biased against said endless belt-like recording medium to keep it in tension, said supporting means including a supporting surface which faces the back side of said recording medium and which is provided with a recess;

a bar-like counter member movably disposed inside of said recess;

means for urging at least either one of said means for removing and said bar-like counter member against the other thereby bringing said means for removing and said bar-like counter member in an intended pressure contact with said recording medium from both sides such that said intended pressure contact is maintained substantially constant during the entire cleaning operation; and means for causing a relative motion between said means for removing and said recording medium thereby allowing said means for removing to remove the residual color particles from the recording surface of said recording medium.

2. The apparatus as in claim 1 wherein said means for removing includes a sleeve which is rotatably supported and which has an outer surface contactable with the recording surface of said recording medium for collecting removed particles thereon.

3. The apparatus as in claim 2 wherein said means for removing further includes a sleeve cleaner which removes the collected particles from the outer surface of said sleeve thereby allowing to present the outer surface of said sleeve for repetitive use.

4. The apparatus as in claim 2 wherein said sleeve is comprised of magnets.

5. The apparatus as in claim 2 wherein said sleeve is made of a non-magnetic material and said means for removing further includes a plurality of magnets disposed inside of said non-magnetic sleeve.

6. The apparatus as in claim 5 wherein the outer surface of said sleeve is provided with fibers.

7. The apparatus as in claim 2 wherein said bar-like counter member is substantially the same length as said sleeve and loosely fitted in said recess.

8. The apparatus as in claim 7 wherein said means for urging is a coil spring provided in said recess for urging said bar-like counter member against said sleeve with a part of said recording medium in-between.

9. The apparatus as in claim 7 wherein said bar-like counter member has a predetermined profile in cross-section.

10. The apparatus as in claim 1 wherein said recording medium is a photosensitive member for use in electrophotography.

11. The apparatus as in claim 1 wherein said recording medium is a dielectric medium for use in electrographic recording.

12. An apparatus for cleaning a recording medium, having a recording surface on which a developed image is formed and a back surface which is on the opposite side of said recording surface, after transferring a developed image comprised of color particles and formed on said recording surface to a transfer medium, thereby preparing said recording medium for use in the next cycle of operation, comprising:

means for removing residual color particles remaining on the recording surface of said recording medium after image transfer, said means for removing being disposed on the recording surface side of said recording medium and including first magnetic means;

a counter member movably dispsed on the back surface side of said recording medium, said counter member including second magnetic means wherein said counter member is normally biased against said means for removing due to a magnetic attractive force between said first and second magnetic means; and means for causing a relative motion between said means for removing and said recording medium thereby allowing said means for removing to remove the residual color particles from the recording surface of said recording medium.

13. The apparatus as in claim 12 wherein said counter member is comprised of a top plate of a support member for supporting rollers around which said recording member in the form of an endless belt is passed, said second magnetic means being fixedly attached to said support member which is shiftable in position with respect to said means for removing.

14. The apparatus as in claim 17 wherein said color particles include a magnetic material.

15. An apparatus for cleaning a recording medium, having a recording surface on which a developed image is formed and a back surface which is on the opposite side of said recording surface, after transferring a developed image comprised of color particles and formed on said recording surface to a transfer medium, thereby preparing said recording medium for use in the next cycle of operation comprising:

means for removing residual color particles remaining on the recording surface of said recording medium after image transfer, said means for removing being disposed on the recording surface side of said recording medium;

a counter member disposed on the back surface side of said recording medium, said counter member having a two layer structure including first and second layers fixed together with said first layer being brought into contact with said recording medium and comprised of a soft material and said second layer being fixed to a support structure and comprised of a rigid material;

means for urging at least either one of said means for removing and said counter member against the other thereby bringing said means for removing and said first layer of said counter member in an intended pressure contact with said recording medium from both sides; and means for causing a relative motion between said means for removing and said recording medium thereby allowing said means for removing to remove the residual color particles from the recording surface of said recording medium.

16. The apparatus as in claim 15, wherein said soft material is selected from the group consisting of rubber, sponge, felt and fur.

17. The apparatus as in claim 15 wherein said soft material is formed by an enclosure of shapeless material such as jelly and liquid.

18. The apparatus as in claim 15 wherein said rigid material is either a magnet or a magnetic material.

19. The apparatus as in claim 18 wherein said means for removing includes a sleeve which is rotatably supported and which has an outer surface contactable with the recording surface of said recording medium for collecting removed particles thereon.

20. The apparatus as in claim 18 wherein said sleeve is comprised of magnets.

21. The apparatus as in claim 18 wherein said sleeve is made of a non-magnetic material and said means for removing further includes a plurality of magnets disposed inside of said non-magnetic sleeve.

* * * * *